US005890913A

United States Patent [19]

Kyllönen

[11] Patent Number: 5,890,913

[45] Date of Patent: Apr. 6, 1999

[54] CONNECTION ARRANGEMENT

[75] Inventor: Kimmo Antero Kyllönen, Oulunsalo, Finland

[73] Assignee: ADC Solitra Oy, Kempele, Finland

[21] Appl. No.: 500,251

[22] Filed: Jul. 10, 1995

[30] Foreign Application Priority Data

Jul. 12, 1994 [FI] Finland ..... 943329

[51] Int. Cl.[6] ..... H01R 9/09

[52] U.S. Cl. ..... 439/63; 439/578

[58] Field of Search ..... 439/63, 578, 874, 439/581

[56] References Cited

U.S. PATENT DOCUMENTS

| | | | |
|---|---|---|---|
| 3,877,775 | 4/1975 | Barlow . | |
| 4,368,940 | 1/1983 | Sugiura | 439/581 |
| 4,666,230 | 5/1987 | Gartzke et al. . | |
| 4,737,601 | 4/1988 | Gartzke | 439/578 |

FOREIGN PATENT DOCUMENTS 0571081 of 0000 European Pat. Off. .

*Primary Examiner*—Steven L. Stephan
*Assistant Examiner*—T C Patel
*Attorney, Agent, or Firm*—Ladas & Parry

[57] ABSTRACT

A connection arrangement, in particular an intermodulation-protected coaxial connection arrangement comprising a cable (1) and a cable connection means (2, 11), such as a coaxial connector (2), a lead-in unit (11) or the like, fixed to the cable. The connection arrangement comprises a conductive thick-walled connection piece (3) having an aperture (3*a*) forming a passage for the cable through the connection piece to the cable connection means (2, 11). The connection arrangement further comprises a crimp connection (5) or the like between the connection piece and the cable connection means, said crimp connection forming between the connection piece (3) and the cable connection means (2, 11) a first closed-circle sealing surface (5) around the aperture (3*a*) comprised by the connection piece (3). The connection arrangement additionally comprises a solder joint (6) or the like provided in the connection piece (3) and forming a second closed-circle sealing surface (6) around the aperture (3*a*) comprised by the connection piece (3) on the opposite side of the connection piece (3) to the first sealing surface (5).

14 Claims, 4 Drawing Sheets

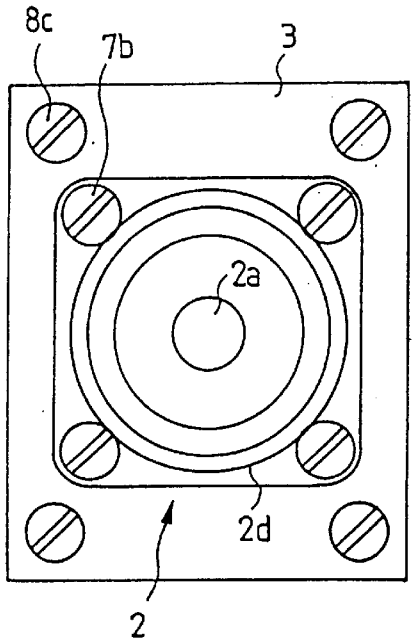
FIG. 9
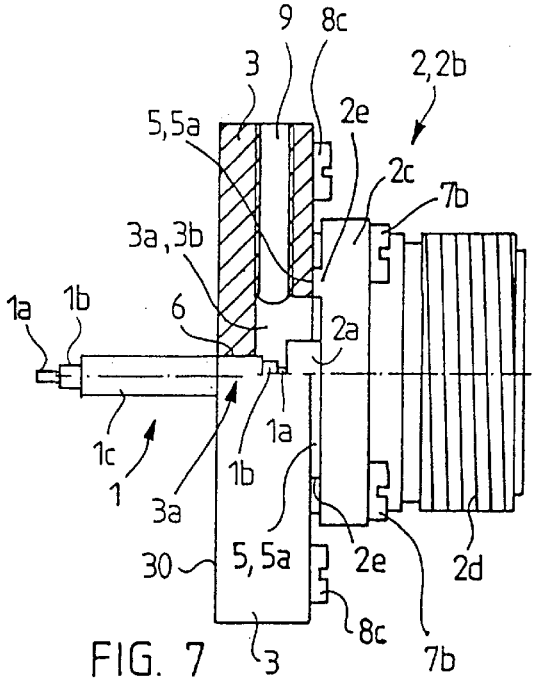
FIG. 7
FIG. 7
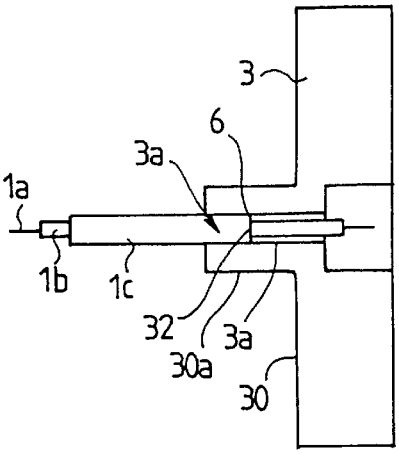
FIG. 11
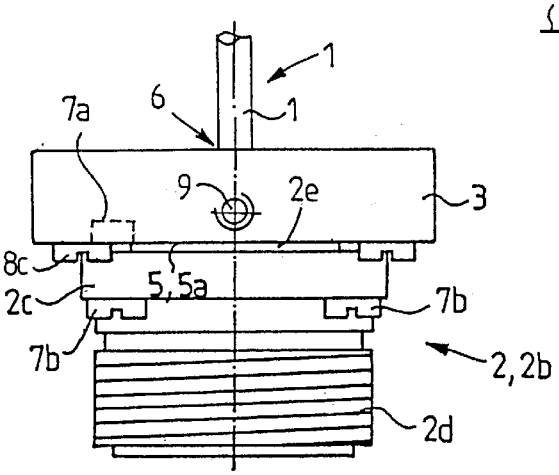
FIG. 8

CONNECTION ARRANGEMENT

BACKGROUND OF THE INVENTION

1. Field of the Invention

The present invention relates to a connection arrangement, in particular an intermodulation-protected coaxial connection arrangement comprising a cable and a cable connection means, such as a coaxial connector, a lead-in unit or the like, fixed to the cable.

A connection arrangement of the above kind is applied in connections for the radio frequency range, for example in connections needed for filters, directional couplers and other equivalent components employed at a base station of a cellular network. These connection arrangements employ cable connection means, such as coaxial connectors or lead-in units.

The invention can e.g. be applied in connection with a coaxial connector to be attached to the outer wall of a housing encasing a filter, directional coupler or some other component or equipment. In particular, the invention involves coupling a coaxial connector to a cable within such a housing and to the wall of the housing. Another practical example is the connection of a lead-in unit to be attached to the outer wall of a filter housing or a housing for a directional coupler or other equipment to a cable brought inside the housing and to the housing wall, and the connection of the outer sheath of the cable to the housing wall. In these applications, the presently known connection arrangements and the methods for making them are such that the cable connection means, such as a coaxial connector or a lead-in unit, is attached directly to the wall by way of clamping means and/or a solder joint.

2. Description of the Prior Art

In connection arrangements for the radio frequency range, a significant problem is presented by intermodulation, which is induced as a combined result of several frequencies. Intermodulation may present a problem particularly at base stations for cellular networks, since several transmission frequencies are employed for different channels at one base station unit, thus causing intermodulation to occur. Intermodulation becomes a real problem when the frequency of the intermodulation is in the same frequency range as the receiving frequency of the base station. Even a small intermodulation will cause problems, as the difference between the transmit power and the intermodulation should be as high as 165 dB. The unit and value for the intermodulation is dependent on the smoothness of the component surfaces and the clamping force between the connected parts of the arrangement. In order to avoid intermodulation, the connection arrangements should be executed with particular care.

As stated previously, in the prior art connection arrangements the cable connection means, such as a coaxial connector or a lead-in unit, is directly coupled for instance to the outer surface of a filter housing. However, the interface between a coaxial connector and a filter housing, for example, cannot always be made so tight that no problem of intermodulation will occur. Particularly in filters of thin sheet construction, it is very difficult to form a sufficiently smooth connection surface against the connector in the wall of the filter housing. If, after completion of the connection arrangement, it is found in test measurement that the connection is not sufficiently tight and shielded against intermodulation, the entire filter must be discarded, which will naturally impair the output and economy of the manufacturing operation. The situation is similar when a lead-in unit is employed as the cable connection means. The prior art connection arrangements also have problems in replacement of the parts of the connection arrangement. Furthermore, the prior art connection arrangements are problematic in regard to their manufacture, as for instance a coaxial connector must be heated thereby to make it well soldered to the surface of the filter housing. It is obvious that such heating will adversely affect the connector structure and the connection surface of the connector, being seated against the filter casing. Heating of the connector will also adversely affect the connections already made between the cable and the cable connection means. These factors further impair the intermodulation suppression of the connection arrangement. In the known arrangements, problems will also be encountered in washing of the executed solder joint.

It is an object of the present invention to provide a novel connection arrangement avoiding the problems related with the prior art.

SUMMARY OF THE INVENTION

This object is achieved with the connection arrangement of the invention, which is characterized in that the connection arrangement comprises a conductive thick-walled connection piece having an aperture forming a passage for the cable through the connection piece to the cable connection means, that the connection arrangement comprises a crimp connection or the like between the connection piece and the cable connection means, said crimp connection forming between the connection piece and the cable connection means a first closed-circle sealing surface around the aperture of the connection piece, and that the connection arrangement comprises a solder joint or the like provided in the connection piece and forming a second closed-circle sealing surface around the aperture of the connection piece on the opposite side of the connection piece to the first sealing surface.

The connection arrangement of the invention affords several advantages. The connection arrangement will be capable of preventing intermodulation from being induced. The connection piece employed in the connection arrangement is such that a very good smooth surface against the cable connection means can be formed therein, and the connection piece also connects the ground planes of the parts to be coupled. The connection arrangement is also such that its parts can be readily replaced, should it be found in test measurement that intermodulation exists. The solder joints in the connection arrangement can also be produced in such a way that soldering of a given solder joint will not adversely affect another solder joint on account of the heat applied. The connection piece required in the connection arrangement consists of one part without any joints that might possibly induce intermodulation. The connection piece comprises a thick wall providing a rigid attachment surface for the cable connection means, such as a coaxial connector or a lead-in unit. The connection piece can also be easily and inexpensively manufactured. A high-quality smooth surface against the cable connection means, such as a coaxial connector or a lead-in unit, can easily be produced in the connection piece. When for example a coaxial connector is to be coupled through a connection piece to the wall of a filter housing, for instance, and if the connection surface to seat against the coaxial connector should be uneven, the expensive filter need no longer be discarded, but it suffices to replace the connection piece with a new one constructed with a better connection surface that will not form a leakage spot for intermodulation. Furthermore, the arrangements for fixing the connection piece and the shape thereof are such as to permit easy attachment and, if necessary, withdrawal, as well as a flat structure. The invention also permits washing of the connections by way of the passage provided in the connection piece.

BRIEF DESCRIPTION OF THE DRAWING

In the following the invention will be described in greater detail with reference to the accompanying drawings in which FIGS. 7–9 and 11 illustrate a third embodiment of the invention.

DESCRIPTION OF THE PREFERRED EMBODIMENTS

Figure 3:
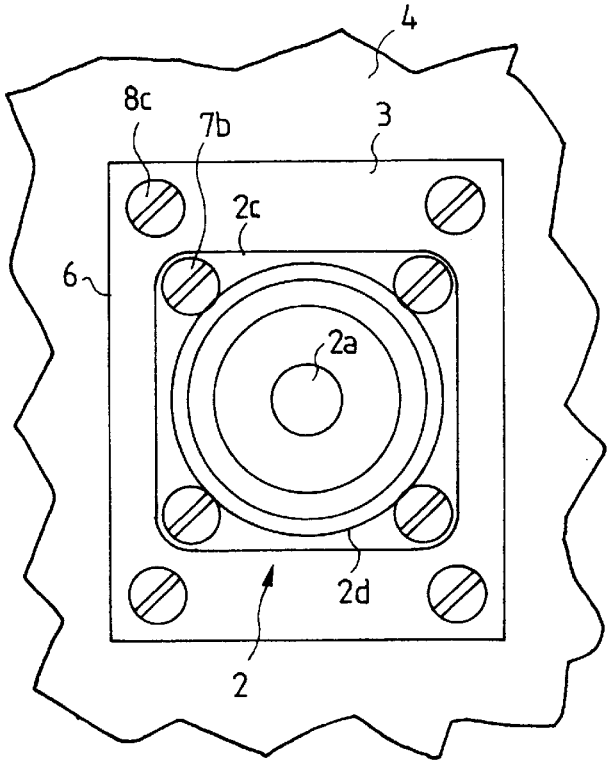
FIGS. 1–3 illustrate a first embodiment of the invention.

With reference to FIGS. 1–3 and 10, a first embodiment of the invention will now be explained. The connection arrangement comprises a cable 1 having an inner conductor 1*a* and an insulator 1*b*. The connection arrangement further comprises a cable connection means 2, which in this embodiment is a coaxial connector 2, including an inner conductor 2*a* and a surrounding body 2*b* that has a connecting head 2*c* and a threaded portion 2*d*. The connecting head 2*c* incorporates a projection 2*e*. Furthermore, the connection arrangement comprises a conductive thick-walled connection piece 3 and a bearing surface 4. The bearing surface is most preferably a filter housing structure, a housing structure for a directional coupler, or an equivalent bearing surface.

The connection piece 3 is thus disposed between the coaxial connector 2 and the bearing surface 4 as an intermediate piece. The connection piece 3 comprises an aperture 3*a*, providing a passage for the cable 1 through the connection piece 3 of the cable connection means 2, in this embodiment the coaxial connector 2, to the inner conductor 2*a* thereof, to which the conductor 1*a* of the cable is attached with a solder joint or an equivalent joint.

Figure 1:
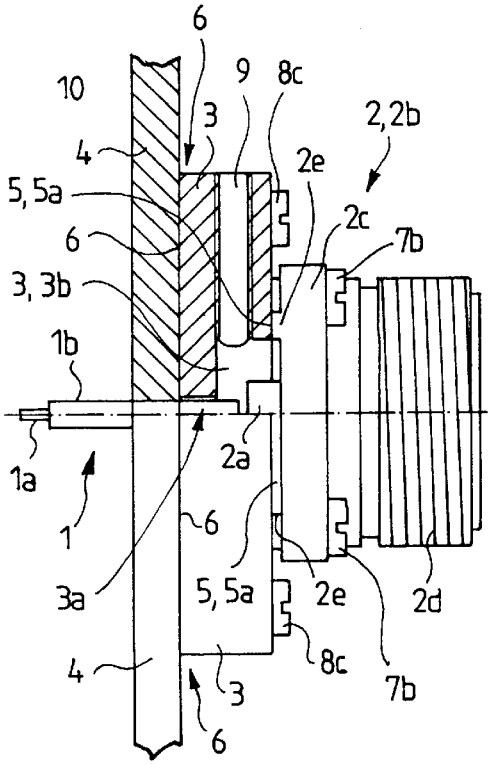
Figure 2:
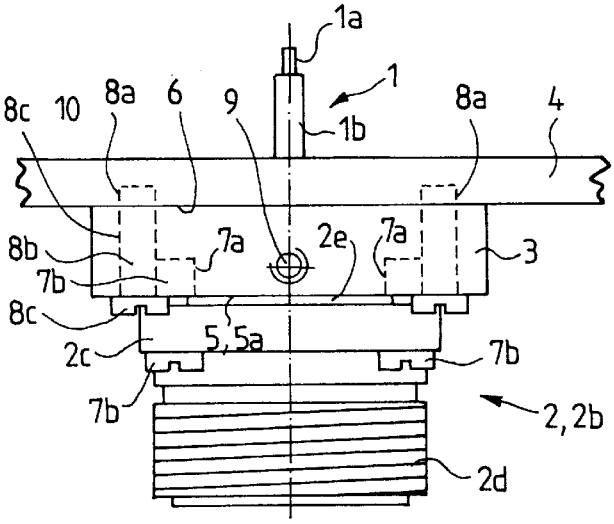

The connection arrangement comprises a clamp connection 5 or the like between the connection piece 3 and the cable connection means 2, said clamp connection forming between the connection piece 3 and the cable connection means 2, in this case the coaxial connector 2, a first closed-circle sealing surface 5 around the aperture 3*a* of the connection piece 3. Furthermore, the connection arrangement comprises a solder joint 6 or the like produced in the connection piece 3, said solder joint forming a second closed-circle sealing surface 6 around the aperture 3*a* of the connection piece 3 on the other side of the connection piece than the first sealing surface 5. In the embodiment of FIGS. 1–3 (as in FIGS. 4–6), the connection piece 3 is attached to the bearing surface 4, and the second sealing surface 6, formed by the solder joint or the like which is included in the connection arrangement, is provided between the bearing surface 4 and the connection piece 3.

In a preferred embodiment, the clamp connection 5 comprises a connection surface 5*a* provided in the connection piece 3, a projection 2*e* provided in the cable connection means, and clamping means 7*a*, 7*b* for clamping the cable connection means, in this case the coaxial connector 2, to the connection piece 3. Most preferably these clamping means are comprised of an inner thread 7*a* provided in the connection piece, and bolts, screws or similar tightening elements 7*b* threaded into the inner thread. The connection surface 5*a* is as smooth as possible. Instead of an inner thread 7*a*, throughgoing holes may be employed, but an inner thread 7*a* is preferable, since it better positions the connection piece.

In a preferred embodiment, in addition to the second sealing surface 6 provided by a solder joint or the like, clamping means 8*a*, 8*b*, 8*c* have been arranged between the bearing surface 4 and the connection piece 3. The clamping means comprise an inner thread 8*a* provided in the bearing surface 4, apertures 8*b* provided in the connection piece, and bolts, screws or similar tightening elements 8*c*. Such a clamping arrangement is necessary firstly in order for the solder joint 6 not to break down when for instance an antenna lead (not shown) is threaded into the coaxial connector, and secondly in order that the solder joint 6 can be better soldered when the connection piece 3, i.e. the intermediate piece, is already tightened against the bearing surface 4, and thirdly in order to provide a tighter and more intermodulation-free connection, as in addition to the solder joint 6 there is a clamp joint between the bearing surface 4 and the connection piece 3, having been produced prior to the solder joint 6 by tightening the connection piece 3 against the bearing surface 4 with the clamping means 8*a*–8*c*.

In a preferred embodiment, the connection piece 3 is such that the aperture 3*a* in the connection piece 3 comprises an enlargement 3*b* on the side of the cable connection means 2, in this case the coaxial connector 2. This enlargement 3*b* enables maintaining the impedance of the transmission line, of which the connection arrangement forms a part. In a preferred embodiment, the connection piece 3 comprises a passage 9 extending into the aperture 3*a*, 3*b* of the connection piece 3, preferably from the side. The passage 9 may in some embodiments (mainly FIGS. 7–9) be employed to relieve pressure produced by the heat applied in soldering, as a washing passage or washing hole for the solder joints, an inspection opening utilizing for example optical fibre, and in certain special cases also for impedance control, preferably closed with a passage closing member, such as a bolt (not shown). It is obvious that in the completed connection arrangement the passage 9 must be closed on account of impurities.

When the invention is contemplated as a method for making a connection arrangement, the procedure is such that the connection piece 3 is tightened by clamping means 8*a*–8*c* against the bearing surface 4, which may be for instance a filter housing structure or a housing structure for a directional coupler or other equipment. Reference numeral 10 indicates the area inside of the bearing surface, e.g. filter housing structure 4. After tightening, a solder joint 6 is made between the connection piece 3 and the support structure 4, providing a second (although the first in time) sealing surface 6 around the aperture 3*a* in the connection piece 3. The bearing surface 4 and the connection piece 3 form a first substructure. A second substructure is obtained when the inner conductor 1*a* of the cable 1 is connected, preferably by soldering, to the inner conductor 2*a* of the coaxial connector 2. The two substructures obtained are combined by making a clamp connection 5, i.e. by tightening the coaxial connector 2 against the connection piece 3, thus producing a first (although the second in time) sealing surface 5 around the aperture 3*a* of the connection piece 3. It is evident that by the time the clamp connection is made, the cable 1 must have been brought through the connection piece 3 and the bearing surface 4, through the aperture 3*a* in the connection piece and the aperture in the bearing surface 4. In the clamp connection 5, the connection surface 5*a* of the connection piece and the projection 2*e* of the coaxial connector 2 are pressed one against the other by means of the clamping means 7*a*, 7*b*. Washing operations are preferably carried out before and after making the solder joint. The connection piece 3 connects the ground planes, in other words, the bearing surface 4 and the body 2*b* of the coaxial connector.

The first preferred embodiment of the invention in accordance with FIGS. 1–3 as described above involved connecting a coaxial connector 2 to a cable 1 and to a bearing surface 4 with the aid of a connection piece 3.

Figure 6:
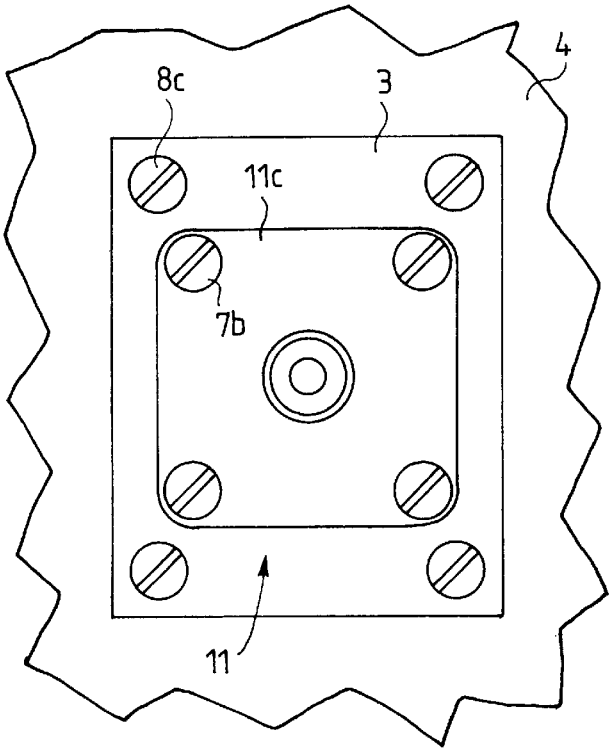
FIGS. 4–6 illustrate another embodiment of the invention.
Figure 4:
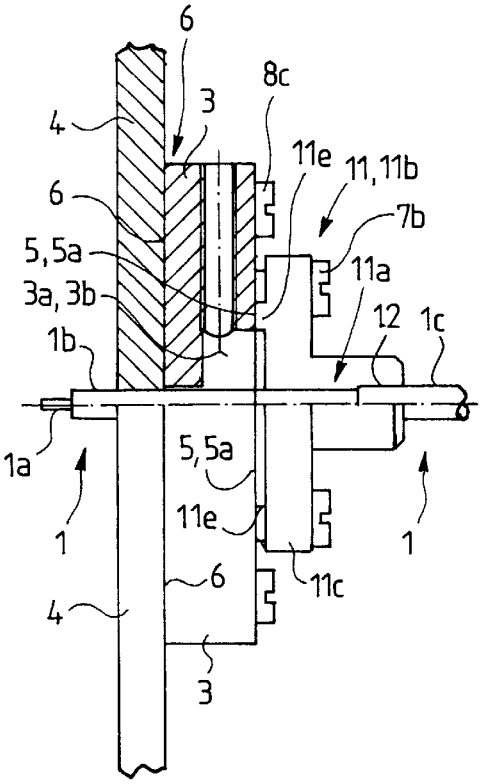
Figure 5:
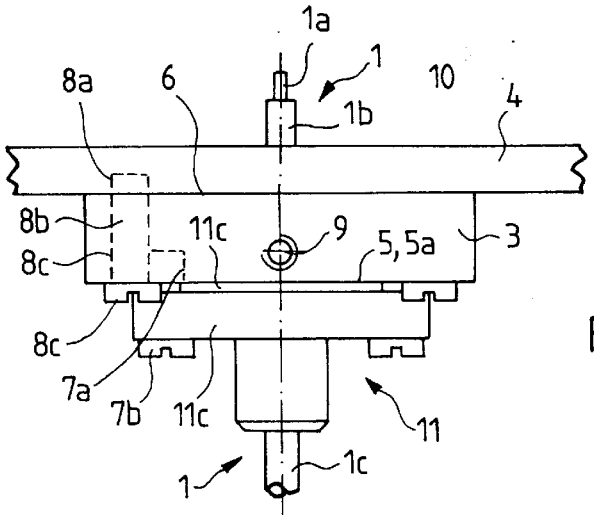
Figure 10:
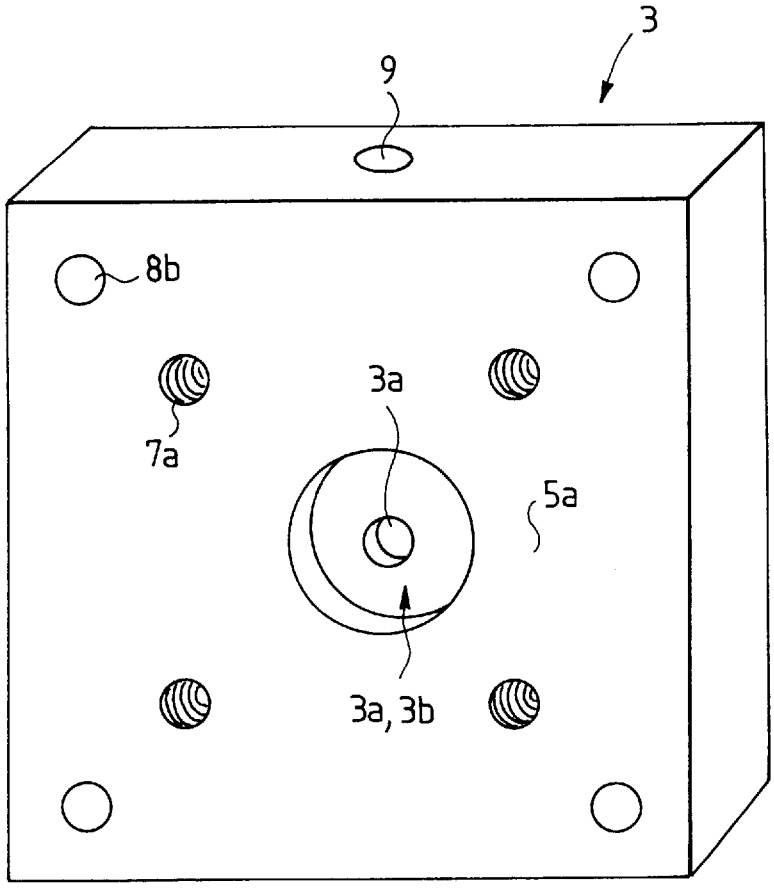
FIG. 10 illustrates a connection piece.

In the second embodiment shown in FIGS. 4–6, the cable connection means is, instead of a coaxial connector, a lead-in unit 11 to which the cable 1 is to be connected and by means of which the cable is attached to a bearing surface 4 through a connection piece 3. The second embodiment of the invention in FIGS. 4–6 is of a type similar to the first embodiment disclosed above. The most significant differences reside in that the cable connection means is a lead-in unit, that the conductive sheath 1*c* of the cable has been soldered to the lead-in unit 11 by means of a solder joint 12 or the like, and that the inner conductor of the cable extends through the entire connection arrangement. The lead-in unit 11, which in FIGS. 4–6 provides the cable connection means, comprises an aperture 11*a*, a body 11*b*, a connecting head 11*c*, and a projection 11*e* in the connecting head. The connection arrangement comprises a conductive thick-walled connection piece 3 having an aperture 3*a* providing a passage for the cable 1 through the connection piece to the cable connection means 11, in this case the lead-in unit 11. In FIGS. 4–6, the cable 1 comprises an inner conductor 1*a*, an insulator 1*b*, and a sheath 1*c*. The connection arrangement comprises a clamp connection 5 or the like between the connection piece and the cable connection means, providing between the connection piece and the cable connection means a first closed-circle sealing surface 5 around the aperture 3*a* of the connection piece 3. The connection arrangement comprises a solder joint 6 or the like in the connection piece 3, providing a second closed-circle sealing surface 6 around the aperture 3*a* of the connection piece 3 on the opposite side of the connection piece to the first sealing surface 5. The sealing surface 6, i.e. the solder joint 6, is between the connection piece 3 and the bearing surface 4, as in the first embodiment.

Similarly as in FIGS. 1–3, also in FIGS. 4–6 the connection arrangement comprises an enlargement 3*b* of the aperture of the connection piece or an equivalent structure that enables maintaining the impedance of the transmission line. The connection arrangement also comprises a connection surface 5*a* in the connection piece 3, a bearing surface 4, such as the wall of a housing for a filter or a directional coupler, sealing surfaces 5 and 6, clamping means 7*a*, 7*b* for tightening the leading unit against the connection piece 3, and second clamping means 8*a*–8*c* for tightening the connection piece 3 against the bearing surface 4 prior to making the solder joint 6. The connection arrangement of FIGS. 4–6 is implemented on the same principle as the connection arrangement of FIGS. 1–3. First, two structures are produced by clamping and soldering the connection piece 3 to the bearing surface 4 and by soldering the cable sheath 1*c* to the lead-in unit 11. The next step is to combine the substructures by clamping the lead-in unit 11 against the connection piece 3 with means 7*a*, 7*b*, thus producing a crimp connection 5 and simultaneously a sealing surface 5. The cable 1 must naturally be brought through the aperture 3*a* and through the bearing surface 4 at least before clamping is performed. The connection piece 3 connects the ground planes, i.e. the bearing surface 4 and the body 11*b* of the lead-in unit. In other respects, reference is made to the description pertaining to FIGS. 1–3.

FIGS. 7–9 show a third embodiment. The connection arrangement of FIGS. 7–9 comprises a cable 1 having an inner conductor 1*a*, an insulator 1*b*, and a sheath 1*c*. The arrangement further comprises as a cable connection means a coaxial connector 2 incorporating an inner conductor 2*a* and a surrounding body 2*b* that has a connecting head 2*c* and a threaded portion 2*d*. The connecting head 2*c* incorporates a projection 2*e*. The connection arrangement also comprises a conductive thick-walled connection piece 3 having an aperture 3*a* for the cable, an enlargement 3*b* of the aperture 3*a*, and a connection surface 5*a*. The arrangement further comprises sealing surfaces 5 and 6, clamping means 7*a*, 7*b* for tightening the coaxial connector against the connection piece to form a clamp connection 5, clamping means 8*a*–8*c* or other fixing means for attaching the connection piece and the entire connection arrangement to a desired site. In FIGS. 7–9, no bearing surface is shown to which the connection arrangement is attached, but it is obvious that the fastening must be executed in some way. The connection arrangement of FIGS. 7–9 can be attached for instance to a front plate or some other kind of bearing surface. The connection arrangement illustrated in FIGS. 7–9 may be implemented as an extension of the connection arrangement shown in FIGS. 4–6, in which case the cable 1 would extend as cable 1 of FIGS. 7–9 from the lead-in unit 11 to the coaxial connector 2.

The most significant difference of the third embodiment shown in FIGS. 7–9 to the first embodiment shown in FIGS. 1–3 is that the second sealing surface 6, i.e. solder joint 6, around the aperture 3*a* is between the sheath 1*c* of the cable 1 and the connection piece 3, preferably so that the solder joint 6 is formed between the wall of the aperture 3*a* of the connection piece 3 and the cable sheath 1*c*. In the embodiments of FIGS. 1–3 and 4–6, the sealing surface 6, i.e. solder joint 6, was between the connection piece 3 and the bearing surface 4.

The connection arrangement of FIGS. 7–9 is produced in such a way that the connection piece 3 is passed, i.e. brought, over the cable 1 and the connection piece 3 is slid along the cable 1 to such an extent that the connection piece 3 will not cause an obstruction. The next step is to solder or otherwise join the inner conductor 1*a* of the cable 1 to the inner conductor 2*a* of the coaxial connector. This is followed by clamping the coaxial connector against the connection piece 3, thus forming a first closed-circle sealing surface 5, i.e. clamp connection 5, which is a closed-circle sealing surface around the aperture 3*a* of the connection piece 3. The next step is to form a second closed-circle sealing surface 6 around the aperture 3*a* by making a solder joint 6 or an equivalent joint between the connection piece 3 and the cable sheath 1*c*. To make the solder joint 6, the connection piece 3 is heated and tin or other soldering material is laid in the junction of the sheath 1*c* and the aperture 3*a*, as a result of which the molten tin will be drawn in between the edges of the aperture 3*a* and the sheath 1*c* and solidify. The passage 9 forming part of the connection arrangement can be employed to relieve the pressure produced in the soldering operation and later as a washing passage and an inspection passage. Finally, the passage 9 is closed with a closing member (not shown).

In all three embodiments, the sealing surfaces 5 and 6 prevent the problem of intermodulation from occurring, since they seal the chamber produced around the cable 1, particularly the inner conductor 1*a* of the cable, that is in the ground potential, i.e. in the ground plane. In all of the above embodiments, the connection piece 3 comprises two substantially parallel planar surfaces, i.e. sides, and an aperture 3*a* between them.

FIG. 11 illustrates a special case of FIG. 7. The preferred embodiment of FIG. 11 differs from FIG. 7 as regards the shaping of surface 30 and the point at which the sheath 1*c* terminates. Instead of being a smooth surface, the surface 30 comprises a protuberance 30*a* through which an aperture 3*a* for the cable has been made. In FIG. 11 at point 32, the sheath 1*c* terminates sufficiently early, i.e. already at protuberance 30*a* in aperture 3*a*, for the solder joint 6 to be executed at a sufficient distance from the connector. This embodiment provides the advantage that the connector will not be heated to such an extent as in the embodiment of FIG. 7.

The second sealing surface 6, which is most preferably a solder joint 6, has thus been provided between the connection piece 3 and the structural part next to it. In the two previous embodiments, in FIGS. 1–3 and 4–6, such a structural part is the bearing surface 4, and thus the second sealing surface 6, i.e. the solder joint, is between the connection piece 3 and the bearing surface 4. In the third embodiment shown in FIGS. 7–9 and 11, such a structural part is the outer sheath 1*c* of the cable, in which case the second sealing surface 6, i.e. the solder joint 6, is between the connection piece 3 and the outer sheath 1*c* of the cable. Most preferably the solder joint 6 is between the aperture 3*a* of the connection piece 3 and the outer sheath 1*c* of the cable. The first sealing surface 5, i.e. the clamp connection 5, is always between the connection piece 3 and the cable connection means. The cable connection means may be a coaxial connector 2 or a lead-in unit 11.

Even though the invention has been explained in the above with reference to the examples in accordance with the accompanying drawings, it is obvious that the invention is not so restricted, but it may be modified in many ways within the scope of the inventive idea disclosed in the claims.

I claim:

1. In a coaxial connection arrangement including a cable and a device for connecting the cable fixed to the cable, the improvement of the coaxial connection arrangement comprising:

I) a conductive connection piece having an aperture forming a passage for the cable through the connection piece to the device;

ii) a clamp connection between the connection piece and the device, said clamp connection forming between the connection piece and the device a first closed-circle sealing surface around the aperture of the connection piece; and iii) a solder joint provided between the connection piece and a conductive member, said solder joint forming between the connection piece and the conductive member a second closed-circle sealing surface around the aperture of the connection piece on the opposite side of the connection piece to the first sealing surface.

2. The coaxial connection arrangement as claimed in claim 1, wherein the clamp connection comprises a connection surface provided in the connection piece, a projection provided in the device, and clamping means for clamping the device to the connection piece (3).

3. The coaxial connection arrangement as claimed in claim 2, wherein the clamping means comprises an inner thread and/or throughgoing holes provided in the connection piece, and tightening elements threaded thereinto.

4. The coaxial connection arrangement as claimed in claim 1, wherein the aperture in the connection piece comprises an enlargement on the side of the device.

5. The coaxial connection arrangement as claimed in claim 1, wherein the connection piece comprises a closable passage extending from the exterior of the connection piece into the aperture of the connection piece.

6. The coaxial connection arrangement as claimed in claim 1, wherein the conductive member is a bearing surface forming part of a housing of a radio frequency filter, a housing of a directional coupler or an equivalent bearing surface.

7. The coaxial connection arrangement as claimed in claim 6, further comprising clamping means arranged between the bearing surface and the connection piece, said clamping means comprising an inner thread provided in the bearing surface, apertures provided in the connection piece, and tightening elements.

8. The coaxial connection arrangement as claimed in claim 1, wherein the conductive member is an outer sheath of the cable.

9. The coaxial connection arrangement as claimed in claim 8, wherein the second sealing surface is formed between the outer sheath of the cable and a wall surrounding the aperture of the connection piece.

10. The coaxial connection arrangement as claimed in claim 1, wherein the device is a coaxial connector.

11. The coaxial connection arrangement as claimed in claim 1, wherein the device is a lead-in unit.

12. The coaxial connection arrangement as claimed in claim 1, wherein the first closed-circle sealing surface is conductive.

13. The coaxial connection arrangement as claimed in claim 1, wherein the connection piece has a first surface for receiving the device and an opposite surface for mounting and the clamp connection is to the first surface.

14. The coaxial connection arrangement as claimed in claim 13, wherein the first and opposite surfaces are substantially flat.

* * * * *